US005120095A

United States Patent [19]

Manigley

[11] Patent Number: 5,120,095

[45] Date of Patent: Jun. 9, 1992

[54] SAFETY LOCK

[76] Inventor: Alain Manigley, 11, chemin des Esserpys, CH - 1032 Romanel-Sur-Lausanne, Switzerland

[21] Appl. No.: 362,389

[22] PCT Filed: Sep. 23, 1988

[86] PCT No.: PCT/CH88/00168

§ 371 Date: May 25, 1989

§ 102(e) Date: May 25, 1989

[87] PCT Pub. No.: WO89/02965

PCT Pub. Date: Apr. 6, 1989

[30] Foreign Application Priority Data

Sep. 25, 1987 [CH] Switzerland ..... 3718/87

[51] Int. Cl.[5] ..... E05C 1/06

[52] U.S. Cl. ..... 292/160; 292/337

[58] Field of Search ..... 292/157, 159, 160, 161, 292/172, 337, 156

[56] References Cited

U.S. PATENT DOCUMENTS

| | | | |
|---|---|---|---|
| 874,830 | 12/1907 | Carroll | 292/161 |
| 972,769 | 10/1910 | Lark | 292/157 |
| 1,280,993 | 10/1918 | Hammer | 292/159 |
| 1,654,221 | 12/1927 | Kline | 292/159 X |
| 1,762,499 | 6/1930 | Baumé | 292/172 |
| 4,063,763 | 12/1977 | van Herpen | 292/160 X |
| 4,902,052 | 2/1990 | Laine | 292/172 X |

FOREIGN PATENT DOCUMENTS

| | | | |
|---|---|---|---|
| 94116 | 5/1969 | France | 292/172 |

*Primary Examiner*—Richard E. Moore
*Attorney, Agent, or Firm*—Woodard, Emhardt, Naughton, Moriarty & McNett

[57] ABSTRACT

The lock comprises four removable bolts (1) screwed onto a bolt tail (2) obtained by means of a tubular profiled section (3). The bolts include an inner fixing screw (4) arranged inside a sleeve (10), the screw bearing against the sleeve in order to block it in position. The screw and the sleeve of the bolt are separable.

19 Claims, 1 Drawing Sheet

SAFETY LOCK

The object of the present invention is a safety lock comprising at least one sliding bolt attached to a bolt tail.

The aim of the invention is to provide a safety lock particularly resistant to house-breaking and on the other hand enabling the length and the dimensions of the bolts to be adapted without dismantling the whole lock.

For this purpose the safety lock in accordance with the invention is characterized in that the bolt tail includes a tubular frame, the locking mechanism being fixed inside the tubular frame.

The lock may include one sliding bolt or a plurality of sliding bolts removably fixed onto the bolt tail.

The bolt tail may include a longitudinal strengthening member fixed inside the tubular frame at the point of attachment of the bolts to the bolt tail. It may equally well include transverse strengthening members fixed inside the tubular frame.

The sliding bolt may be attached to the bolt tail by being screwed onto it.

The sliding bolt may include a first portion including attachment members intended for cooperating with attachment members on the bolt tail for attachment of the bolt to the bolt tail, and at least one second portion separarable from the first, the second portion being arranged around the first.

In accordance with one embodiment the sliding bolt comprises an inner portion in the form of a cylindrical rod having a male thread extending from one end of it over at least part of its length and screwed into a hole having a corresponding female thread in the bolt tail, the other end of the rod having a head portion of larger diameter than the diameter of the rod and forming a shoulder projecting outwards with respect to the axis of the rod, and an outer portion separable from the inner portion, in the form of a tube open at both ends and of inner diameter substantially larger than the outer diameter of the rod and having at one end of it a seat of dimensions substantially greater than those of the head portion of the inner portion and intended for seating the said head portion and forming a shoulder projecting inwards with respect to the axis of the tube, the shoulder on the head portion bearing against the shoulder of the seat in the outer portion. The outer portion of the bolt may be realized from hardened steel.

The lock may include a kepper equipped at the base of it with tenons intended for being fixed into the wall in a position inclined with respect to the central plane of the keeper in the direction opposite to the angle of rotation in opening the door.

As will become evident from the description which is to follow, the safety lock in accordance with the invention is not only very resistant to house-breaking but offers the advantage of being very easy to fit.

Figure 1:
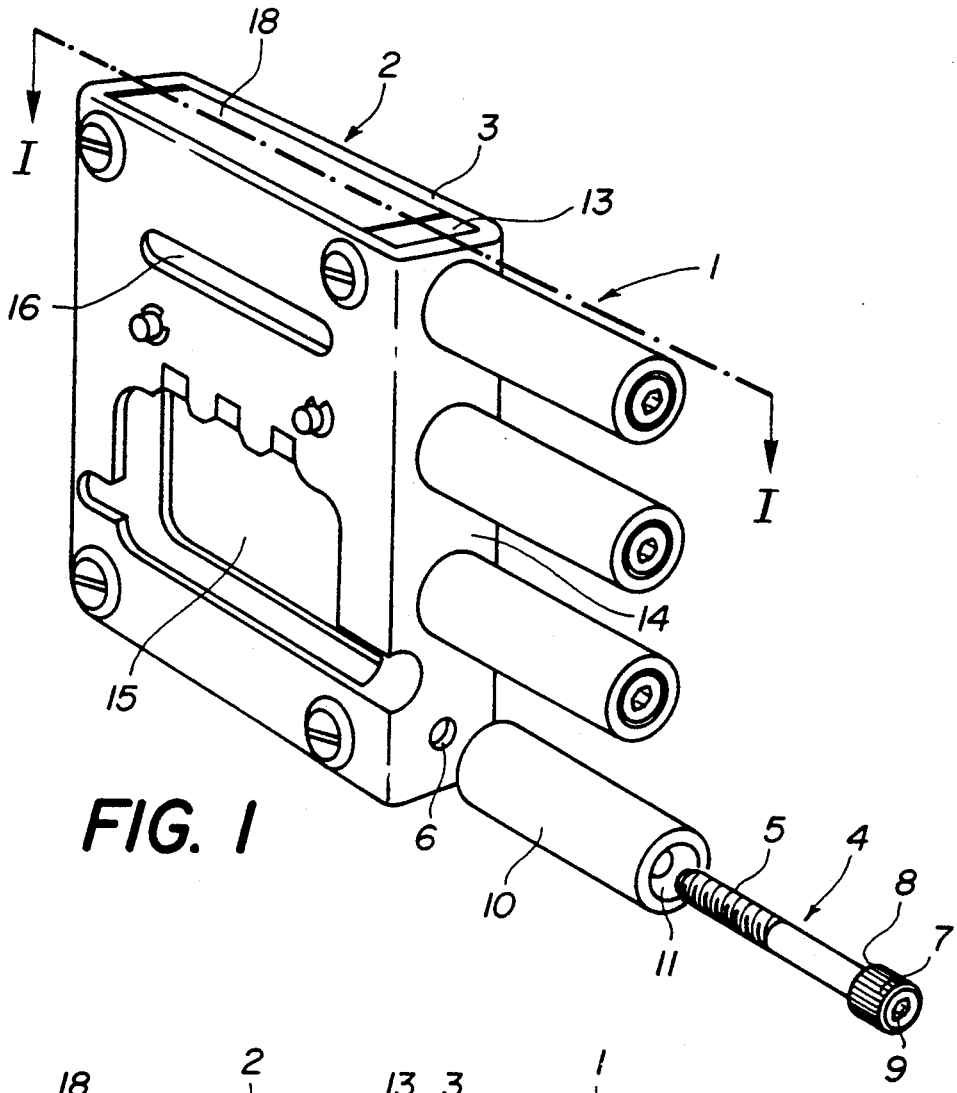
Figure 2:
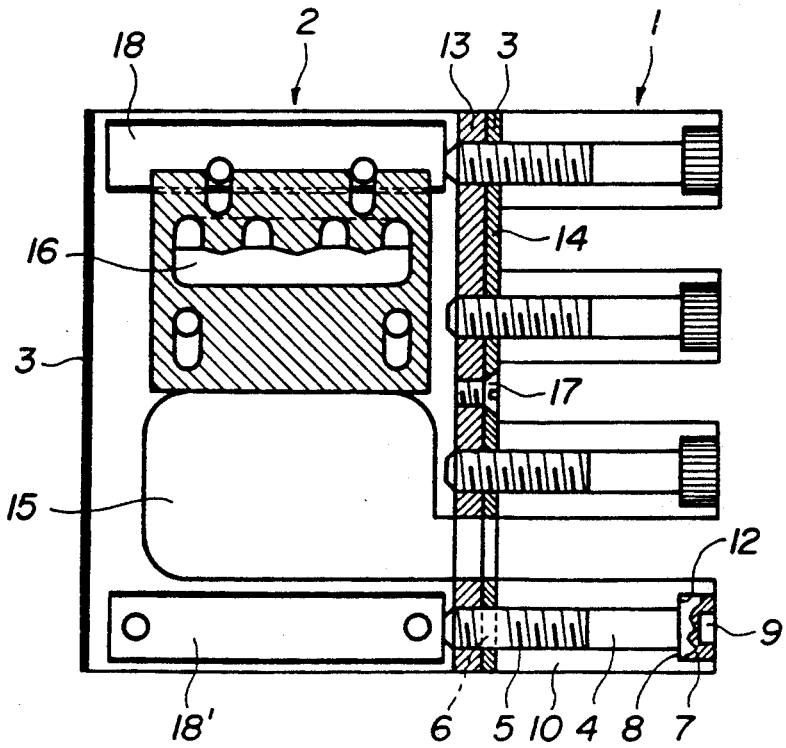

Other advantages and favourable characteristics of the safety lock in accordance with the invention will become more clearly evident from the description of an embodiment given below by way of example by referring to the attached drawing in which:

FIG. 1 represents a perspective of an embodiment of the portion of a safety lock including four sliding bolts attached to one bolt tail, and FIG. 2 is a vertical section along I—I in FIG. 1.

As represented in FIGS. 1 and 2, the safety lock includes four sliding bolts 1 attached to one bolt tail 2.

The bolt tail is obtained by means of a tubular profiled section 3 of generally rectangular outer shape and of rectangular section. A vertical strengthening bar 13 is fixed inside the tubular profiled section by means, for example, of a screw 17, along one of its short sides 14. The strengthening bar may of course also be fixed to the tubular profiled section by spot welds or by gluing.

The tubular profiled section also includes two square tubes 18, 18' for transverse strengthening, fixed inside the tubular profiled section at each end of it. The presence of these strengthening members has the aim of pushing back the point of pivot of the whole in case of house-breaking and consequently of increasing the resistance to the house-breaking.

Four holes 6 distributed along the short side 14 of the tubular profiled section and passing right through the thickness of the wall of the profiled section and of the strengthening bar, are intended for screwing the sliding bolts onto the bolt tail. For this purpose the holes 6 include a female thread. The locking mechanism, not shown, is fixed inside the bolt tail. For this purpose the tubular profiled section 3 includes openings such as 15, 16, intended in particular for fitting the said locking system and for the guidance and driving of this assembly. The realization of these openings in the tubular profiled section may advantageously be effected by cutting out by laser.

The configuration of the bolt tail with a tubular shape as described above enables exceptional resistance to bending to be obtained.

The sliding bolts 1 are composed of a fixing screw 4 passing through an outer sleeve 10. The fixing screw includes a male thread extending from one end of it over about half the length of the screw. It includes in addition a head portion 7 of outer diameter larger than that of the screw body to form a shoulder 8 projecting outwards with respect to the axis of the screw. The endface of the head portion of the screw includes a cell portion of hexagonal shape intended for receiving the head of a screwdriver or other instrument for screwing. The sleeve 10 is of cylindrical shape and open at both ends. Its inner diameter is substantially larger than the outer diameter of the screw 4 so that the screw can slide easily inside the sleeve. It includes at one end of it a seat 11 of dimensions substantially greater than those of the head 7 of the screw and intended for seating this head when the screw which passes through the sleeve is screwed into the holes 6 in the bolt tail. Tightening of the bolts is obtained by butting of the shoulder 8 on the head portion of the screw against the shoulder 12 of the seat in the sleeve, the sleeve otherwise bearing against the face 14 of the bolt tail.

In accordance with a particular embodiment of the safety lock described above the outer dimensions of the bolt tail may, for example, be $80 \times 110 \times 20$ millimetres, the thickness of the wall of the tubular profiled section being 2.5 millimetres. The resistance to bending of the bolt tail of the example above is particularly high. It may be determined by calculation that this resistance is about two thirds of the resistance that would be obtained by replacing the tube by a massive part of the same thickness.

In accordance with a variant embodiment the screws for attachment of the bolts may be longer so as to pass right through the width of the tube and be fixed into the short side of the tube opposite the short side 14 or to a vertical strengthening bar fixed to the said opposite short side.

The realization of the bolt tail by means of a tubular profiled section, the section and the material of which may be determined in accordance with the degree of safety desired, enables an extreme rigidity of the whole to be obtained. The choice of the profiled part for the manufacture of the bolt tail is effected as a function of the resistance of the tube to bending and of the possibility of arranging the locking mechanism inside it. Similarly the section and the hardness of the material serving for the manufacture of the portions forming the bolt, that is to say, of the sleeve and the fixing screw, may be chosen as a function of the safety desired. Again, these characteristics may at any time be modified because the bolts are screwed onto the bolt tail and consequently may be replaced. The portions forming the bolt and in particular the sleeve may for example, be realized from hardened steel of great hardness. The sleeve is then very difficult to saw through, whilst preserving a non-brittle core if the latter is not hardened.

The bolt tail is machined so as to be able to slide without the bolts in the lock casing. This characteristic enables mounting of the bolts to be effected once the lock has been fixed, as well as dismounting of the said bolts at the time of adjustment of the keeper.

The keeper will preferably be equipped at its base with tenons fixed into the wall and inclined with respect to the central plane of the keeper in the direction opposite to the angle of rotation in opening the door. In order to improve the effective strength of the tenons, at least two tenons will be arranged in a dovetail with respect to one another. The section and the length of the tenons may be determined by the degree of safety sought, as a function of the results of a calculation which may be effected with the aim of avoiding their flexing when they are subjected to a force. At the time of an attempt to burst in, this inclined configuration of the tenons enables rotations of the keeper about itself to be avoided and compels the keeper to move towards the lock, which has the result of avoiding dissociation of the keeper-lock assembly under an excessive thrust.

I claim:

1. A safety lock including at least one sliding bolt (1) removably attached to a bolt tail (2), characterized in that the bolt tail includes a tubular frame (3); a longitudinal strengthening member (13) fixed inside the tubular frame at the points of attachment of sliding bolts to the bolt tail; transverse strengthening members (18, 18') fixed inside the tubular frame; and a locking mechanism fixed inside the tubular frame.

2. A lock as in claim 1, characterized in that the bolt comprises a first portion (4) including attachment members (5) intended for cooperating with attachment members (6) on the bolt tail for the attachment of the bolt to the bolt tail, and at least one second portion (10) separable from the first, the second portion being arranged around the first.

3. A lock as in claim 2, characterized in that the bolt comprises an inner portion (4) in the form of a cylindrical rod having a male thread (5) extending from one end of its over at least part of its length and screwed into a hole (6) having a corresponding female thread in the bolt tail, the other end of the rod having a head portion (7) of larger diameter than the diameter of the rod and forming a shoulder (8) projecting outwards with respect to the axis of the rod, and an outer portion (10) separable from the inner portion, in the form of a tube open at both ends and of inner diameter substantially larger than the outer diameter of the rod and having at one end of it a seat (11) of dimensions substantially greater than those of the head portion of the inner portion and intended for seating the said head portion and forming a shoulder (12) projecting inwards with respect to the axis of the tube, the shoulder (8) on the head portion bearing against the shoulder (12) of the seat in the outer portion.

4. A lock as in claim 3, characterized in that the outer portion of the bolt is of hardened steel.

5. A lock as in claim 4, characterized in that it includes a keeper equipped at the base of it with tenons intended for being fixed into the wall in a position inclined with respect to the central plane of the keeper in the direction opposite to the angle of rotation in opening the door.

6. A lock as in claim 5, characterized in that it includes a plurality of bolts removably attached onto the bolt tail.

7. A lock as in claim 6, characterized in that the bolt is attached to the bolt tail by being screwed onto it.

8. A safety lock including at least one sliding bolt (1) removably attached to a bolt tail (2), characterized in that the bolt tail includes a tubular frame (3), and a locking mechanism fixed inside the tubular frame, and being further characterized in that each bolt comprises a first portion (4) including attachment members (5) intended for cooperating with at least one attachment member (6) on the bolt tail for the attachment of each bolt to the bolt tail, and at least one second portion (10) separable from the first, the second portion being arranged around the first; each bolt further comprising an inner portion (4) in the form of a cylindrical rod having a male thread (5) extending from one end of it over at least part of its length and screwed into a hole (6) having a corresponding female thread in the bolt tail, the other end of the rod having a head portion (7) of larger diameter than the diameter of the rod and forming a shoulder (8) projecting outwards with respect to the axis of the rod, and an outer portion (10) separable from the inner portion, in the form of a tube open at both ends and of inner diameter substantially larger than the outer diameter of the rod and having at one end of it a seat (11) of dimensions substantially greater than those of the head portion of the inner portion and intended for seating the said head portion and forming a shoulder (12) projecting inwards with respect to the axis of the tube, the shoulder (8) on the head portion bearing against the shoulder (12) of the seat in the outer portion.

9. A lock as in claim 8, characterized in that the outer portion of the bolt is of hardened steel.

10. A lock as in claim 9, characterized in that it includes a keeper equipped at the base of it with tenons intended for being fixed into the wall in a position inclined with respect to the central plane of the keeper in the direction opposite to the angle of rotation in opening the door.

11. A safety lock including at least one sliding bolt (1) attached to a bolt tail (2), characterized in that the bolt tail includes a tubular frame (3), and a locking mechanism fixed inside the tubular frame, and being further characterized in that the bolt tail includes a longitudinal strengthening member (13) fixed inside the tubular frame at the point of attachment of the bolts to the bolt tail and transverse strengthening members (18, 18') fixed inside the tubular frame.

12. A safety lock including at least one sliding bolt (1) attached to a bolt tail (2), characterized in that the bolt tail includes a tubular frame (3), transverse strengthening members (18, 18') fixed inside the tubular frame and a locking mechanism fixed inside the tubular frame.

13. A safety lock including at least one sliding bolt (1) attached to a bolt tail (2), characterized in that the bolt tail includes a tubular frame (3), and a locking mechanism fixed inside the tubular frame, and further characterized in that it includes a keeper equipped at the base of it with tenons intended for being fixed into the wall in a position inclined with respect to the central plane of the keeper in the direction opposite to the angle of rotation in opening the door.

14. An assembly including at least one sliding bolt removably attached to a bolt tail, wherein said bolt tail comprises a tubular frame having a rectangular cross section, the inner space of which forms a housing for the locking mechanism of a safety lock, the lateral walls of said frame being provided with at least one opening for fitting said locking mechanism, and a longitudinal strengthening member fixed inside said tubular frame at the point of attachment of each of the bolts to the bolt tail.

15. An assembly according to claim 14, wherein said bolt tail is provided with transverse strengthening members fixed inside said tubular frame.

16. An assembly according to claim 14, wherein each bolt comprises a first portion including attachment members intended for cooperating with attachment members on the bolt tail for the attachment of the bolt to the bolt tail, and at least one second portion separable from the first, the second portion being arranged around the first.

17. An assembly according to claim 16, wherein each bolt comprises an inner portion in the form of a cylindrical rod having a male thread extending from one end of its over at least part of its length and screwed into a hole having a corresponding female thread in the bolt tail, the other end of the rod having a head portion of larger diameter than the diameter of the rod and forming a shoulder projecting outwards with respect to the axis of the rod, and an outer portion separable from the inner portion, in the form of a tube open at both ends and of inner diameter substantially larger than the outer diameter of the rod and having at one end of it a seat of dimensions substantially greater than those of the head portion of the inner portion and intended for seating the said head portion and forming a shoulder projecting inwards with respect to the axis of the tube, the shoulder of the head portion bearing against the shoulder of the seat in the outer portion.

18. An assembly according to claim 17 wherein the outer portion of each bolt is made of hardened steel.

19. An assembly including at least one sliding bolt attached to a bolt tail, wherein said bolt tail comprises a tubular frame, the inner space of which forms a housing for the locking mechanism of a safety lock, the lateral walls of said frame being provided with at least one opening for fitting said locking mechanism, and a longitudinal strengthening member fixed inside said tubular frame at the point of attachment of each of the bolts to the bolt tail.

* * * * *

UNITED STATES PATENT AND TRADEMARK OFFICE

CERTIFICATE OF CORRECTION

PATENT NO. : 5,120,095

DATED : June 9, 1992

INVENTOR(S) : Alain Manigley

It is certified that error appears in the above-identified patent and that said Letters Patent is hereby corrected as shown below:

Column 1, line 49, change the word "kepper" to --keeper--.

Column 3, line 60, change the word "its" where it appears in the first instance to the word --it--.

Column 6, line 6, change the word "its" where it appears in the first instance to the word --it--.

Signed and Sealed this

Twenty-first Day of September, 1993

Bruce Lehman

*Attest:*

BRUCE LEHMAN

*Attesting Officer*

*Commissioner of Patents and Trademarks*